US006986405B2

(12) United States Patent
Meeker

(10) Patent No.: US 6,986,405 B2
(45) Date of Patent: Jan. 17, 2006

(54) LADDER WITH LEG BRACE

(75) Inventor: Paul K. Meeker, Hiram, OH (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/623,782

(22) Filed: Jul. 21, 2003

(65) Prior Publication Data

US 2005/0016796 A1 Jan. 27, 2005

(51) Int. Cl.
*E06C 1/00* (2006.01)

(52) U.S. Cl. ..... 182/176; 182/25

(58) Field of Classification Search ..... 182/25, 182/165, 176, 180.1
See application file for complete search history.

(56) References Cited

U.S. PATENT DOCUMENTS

| | | | | |
|---|---|---|---|---|
| 121,190 | A | | 11/1871 | Oakley |
| 159,319 | A | | 2/1875 | Grunewald |
| 317,884 | A | | 5/1885 | Temple |
| 531,641 | A | * | 1/1895 | Payne ..... 5/306 |
| 540,948 | A | | 6/1895 | Bruch |
| 551,445 | A | | 12/1895 | Liefer |
| 554,695 | A | * | 2/1896 | Hood ..... 182/116 |
| 847,205 | A | * | 3/1907 | Rowe ..... 182/230 |
| 870,940 | A | | 11/1907 | Dahl |
| 920,733 | A | | 5/1909 | Groves |
| 1,110,700 | A | | 9/1914 | LeVey |
| 1,212,548 | A | * | 1/1917 | Parent ..... 248/440 |
| 1,549,402 | A | * | 8/1925 | Wittliff ..... 248/188.1 |
| 2,172,860 | A | * | 9/1939 | Weaver ..... 182/123 |
| 2,470,053 | A | | 5/1949 | Salisbury |
| 2,960,181 | A | * | 11/1960 | Bufogle ..... 182/176 |
| 4,995,525 | A | * | 2/1991 | Kehrer ..... 220/694 |
| 5,715,909 | A | | 2/1998 | Gagnon |
| 5,752,581 | A | | 5/1998 | Orchowski |
| 6,427,805 | B1 | | 8/2002 | Gibson et al. |
| 2003/0132058 | A1 | * | 7/2003 | Pollock ..... 182/25 |

* cited by examiner

*Primary Examiner*—Alvin Chin-Shue
(74) *Attorney, Agent, or Firm*—Barnes & Thornburg LLP

(57) ABSTRACT

A ladder comprises a foldable frame, a leg spreader, and a leg brace. The leg brace biases leg units of the frame toward one another to stiffen the frame in response to spreading of the leg units away from one another to an unfolded position by the leg spreader.

9 Claims, 5 Drawing Sheets

LADDER WITH LEG BRACE

BACKGROUND

The present disclosure relates to ladders. More particularly, the present disclosure relates to stabilization of ladders.

Ladders have a frame and one or more steps that people use for elevation when reaching for objects, painting walls, or any everyday task where extra elevation would be helpful. Some ladders can be folded for ease of storage when the ladder is not being used.

SUMMARY

According to the present disclosure, a ladder is provided. A foldable frame of the ladder includes first and second leg units which can be moved relative to one another between folded and unfolded positions. A leg brace is coupled to the leg units to bias the leg units toward one another to stiffen the frame in response to spreading of the leg units away from one another to the unfolded position by a leg spreader.

The leg brace is, for example, X-shaped and includes a pair of cables and a cable connector. One of the cables is coupled to a pair of legs of the first leg unit. The other cable is coupled to a pair of legs of the second leg unit. The cable connector is coupled to a middle portion of each cable and is configured, for example, as a small sleeve surrounding and deformed to grip the cable middle portions.

The cable brace is useful with a variety of leg spreaders. For example, in one embodiment, the leg spreader includes an overcenter linkage that locks the leg units in the unfolded position. In other another embodiment, the leg spreader includes a step coupled to one of the leg units for pivotable movement and a link coupled to the step and the other leg unit for relative movement of the leg units upon pivotable movement of the step.

Additional features of the apparatus will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which.

DETAILED DESCRIPTION

Figure 1:
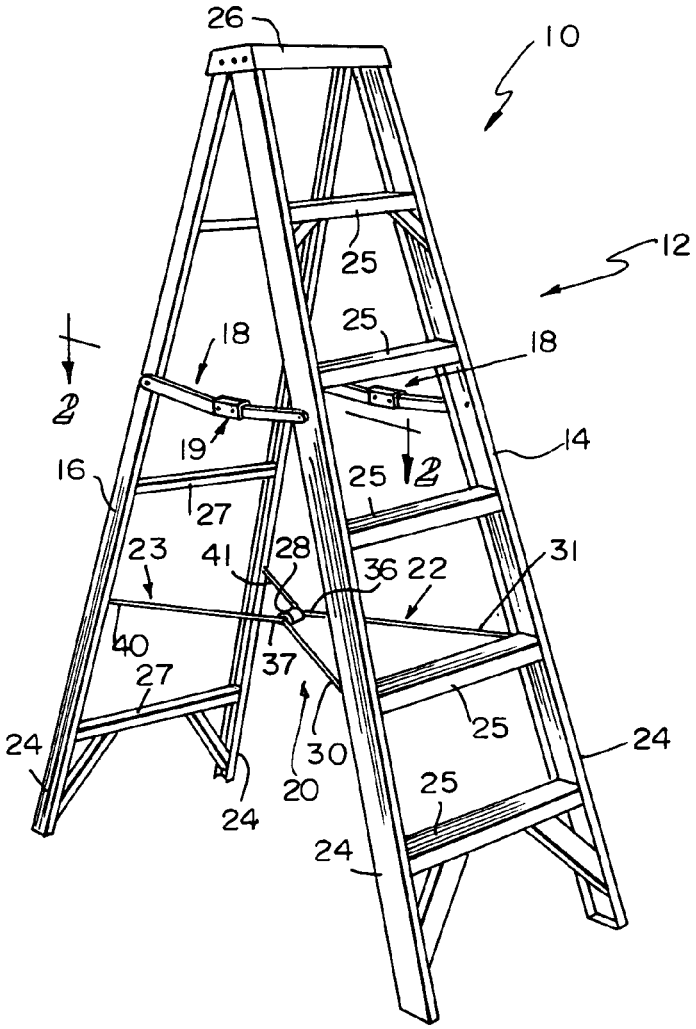
FIG. 1 is a perspective view showing a ladder including a foldable frame and an X-shaped leg brace that is coupled to legs of front and rear leg units of the frame and that is tensioned to bias the leg units toward one another to stiffen the frame in response to spreading of the leg units away from one another to an unfolded position by a leg spreader in the form of, for example, an overcenter linkage.
Figure 2:
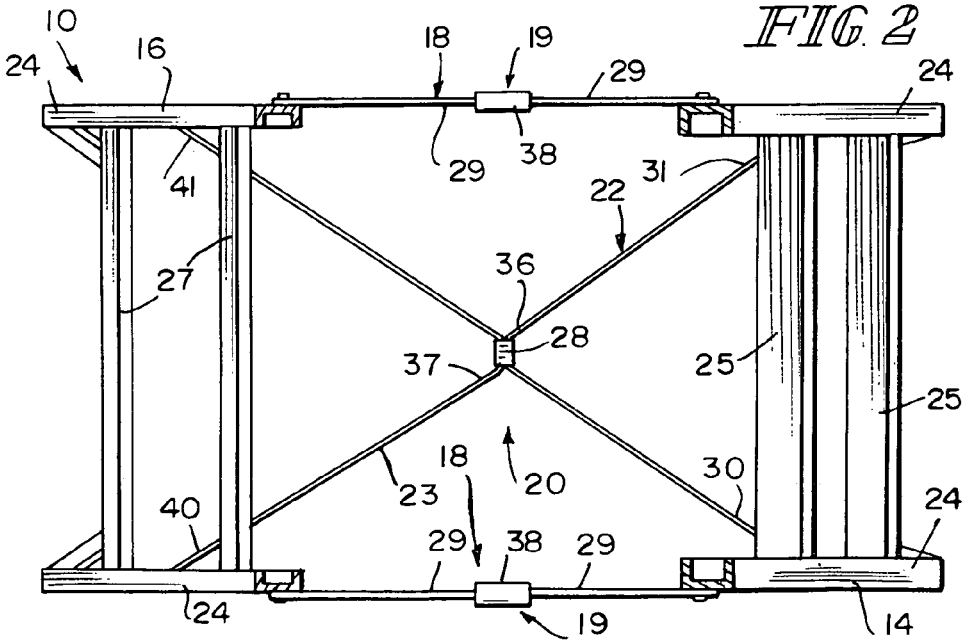
FIG. 2 is a sectional view taken along lines 2—2 of FIG. 1 showing the X-shaped leg brace including a cable connector coupled to a first cable that is coupled to the legs of the front leg unit (on the right) and a second cable that is coupled to the legs of the rear leg unit (on the left)

A ladder 10 includes a foldable frame 12, a leg spreader 18, and a leg brace 20 as shown in FIGS. 1 and 2. Front and rear leg units 14, 16 of the frame 12 are arranged for movement between a folded position shown in FIG. 3 and an unfolded position shown in FIGS. 1, 2, and 5. Leg brace 20 is used to bias leg units 14, 16 toward one another to stiffen frame 12 in response to spreading of leg units 14, 16 away from one another to the unfolded position by leg spreader 18. Stiffening frame 12 promotes overall stability of ladder 10.

Each leg unit 14, 16 includes a pair of legs 24. Front leg unit 14 includes a number of steps 25 extending between legs 24 of front leg unit 14. A number of cross members 27 extend between legs 24 of rear leg unit 16. A pivot joint 26 is coupled to leg units 14, 16 for relative pivotable movement of leg units 14, 16 between the folded and unfolded positions.

Figure 5:
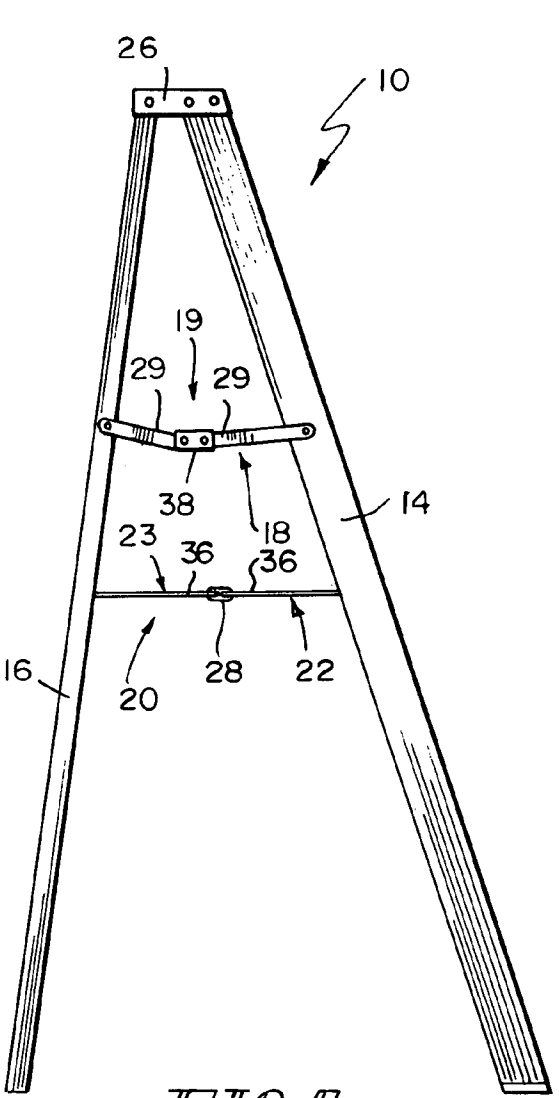
FIG. 5 is a side elevation view showing the ladder in the unfolded position.
Figure 4:
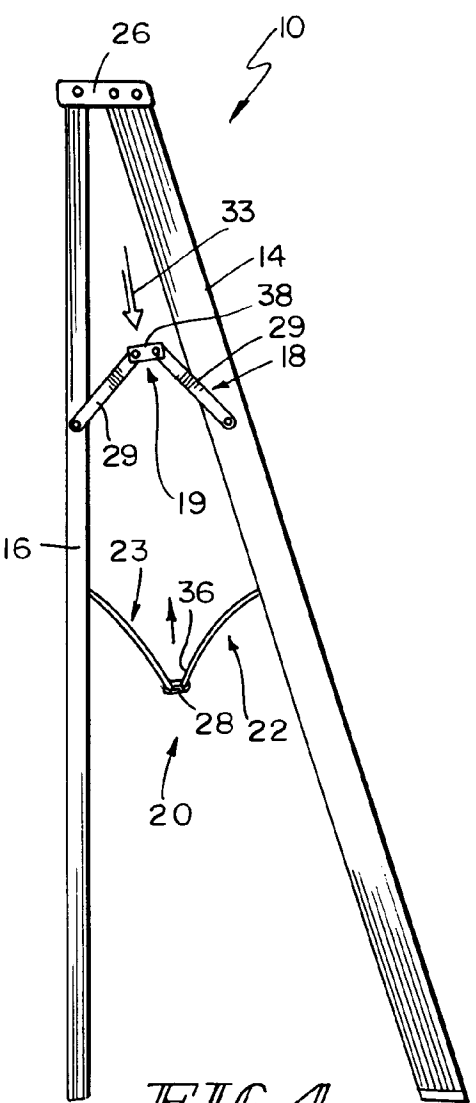
FIG. 4 is a side elevation view showing unfolding of the ladder.
Figure 3:
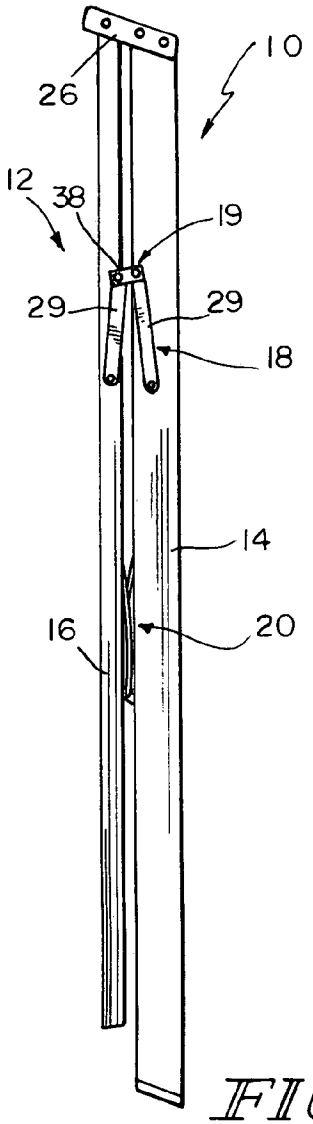
FIG. 3 is a side elevation view showing the ladder in a folded position.

Leg spreader 18 is arranged to pivot leg units 14, 16 away from one another to the unfolded position, as suggested in FIGS. 3–5. Leg spreader 18 thus provides means for spreading leg units 14, 16 away from one another to the unfolded position. Leg spreader 18 includes a pair of overcenter linkages 19 on opposite sides of frame 12. Linkages 19 are similar to one another in structure and function so that the description of one linkage 19 applies to the other linkage 19 as well.

Linkage 19 is coupled to a leg 24 of each leg unit 14, 16, as shown in FIG. 2. Linkage 19 includes a pair of links 29 and a connecting bracket 38. Each link 29 is pivoted to one of legs 24 and connecting bracket 38. A downward force 33 shown in FIG. 5 and applied to connecting bracket 38 is transmitted through links 29 to leg units 14, 16 to cause relative pivotable movement of leg units 14, 16 away from one another until bracket 38 engages links 29 in an "overcenter," locking position so as to lock leg units 14, 16 in the unfolded position.

Spreading of leg units 14, 16 to the unfolded position tensions leg brace 20. When leg brace 20 is tensioned, it exerts an inward force on leg units 14, 16 so as to bias them toward one another. Leg spreader 18 resists relative inward movement of leg units 14, 16 toward one another when linkages 19 are deployed to their overcenter, locking position. Such operation of leg brace 20 and leg spreader 18 stiffens frame to promote stability of ladder 10.

Figure 6:
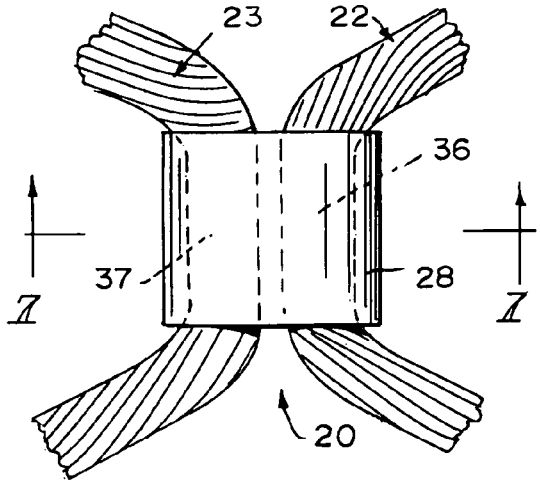
FIG. 6 is an enlarged top plan view, with portions broken away, showing the cable connector coupled to middle portions of the first and second cables of the X-shaped leg brace.

An embodiment of leg brace 20 is shown throughout the drawings. The illustrated leg brace 20 is X-shaped and includes a flexible tether such as a first cable 22 and a second cable 23 coupled to each leg unit 14, 16, as shown in FIG. 2. First cable 22 is coupled to legs 24 of front leg unit 14. Second cable 23 is coupled to legs 24 of rear leg unit 14. A cable connector 28 included in leg brace 20 is coupled to a middle portion 36 of first cable 22 and middle portion 37 of second cable 23, as shown in FIGS. 6 and 7, to establish the X shape of leg brace 20.

Figure 8:
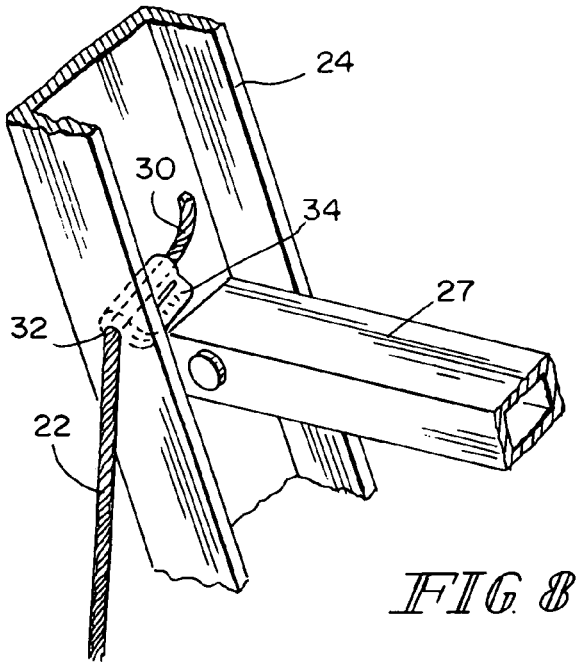
FIG. 8 is an enlarged perspective view showing an end of one of the cables coupled to one of the legs.

A first end portion 30 and a second end portion 31 of cable 22 is coupled to each leg 24 of front leg unit 14 and a first end portion 40 and a second end portion 41 of cable 23 is coupled to each leg 24 of rear leg unit 16, as shown with respect to one of end portions 30 in FIG. 8. End portion 30 extends through an aperture 32 formed in leg 24. A blocker 34 is coupled to end portion 30 to block withdrawal thereof from aperture 32 to prevent detachment of end portion from leg 24.

Figure 7:
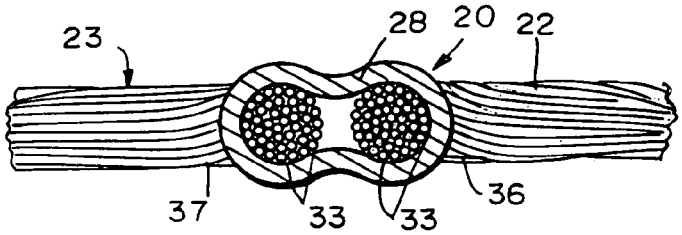
FIG. 7 is a sectional view taken along lines 7—7 of FIG. 6.

Each cable 22, 23 is relatively flexible and strong and includes a plurality of strands 33 of material made of, for example, steel or other metal material, as shown in FIG. 7. The flexibility of cables 22, 23 allows folding of leg brace 20 upon folding of frame 12, as suggested in FIG. 3, for ease of storage of ladder 10. The strength of cables 22, 23 facilitates tensioning of cables 22, 23. Each cable 22, 23 is arranged to be tensioned to bias legs 24 toward a central portion of leg brace 20 (defined by connector 28 and middle portions 36) to stiffen frame 12 to promote overall stability of ladder 10 upon pivotable movement of leg units 14, 16 to the unfolded position by leg spreader 18. In other embodiments, the flexible tethers may be cords, chains, lines, ropes, or the like.

The illustrated cable connector 28 is configured as a sleeve, as shown in FIG. 7. Middle portion 36 of cable 22 and middle portion 37 of cable 23 extend through sleeve 28. Sleeve 28 is crimped or otherwise deformed to grip middle portions 36.

Leg brace 20 is useful with another ladder 110 shown FIGS. 9–12. Ladder 110 includes a frame 112 and a leg spreader 118. Frame 112 includes front and rear leg units 114, 116 which are coupled to one another for pivotable movement between folded and unfolded positions, as suggested in FIGS. 10–12. One of cables 22 is coupled to legs 124 of front leg unit 114 and the other cable 23 is coupled to legs 124 of rear leg unit 116. Cables 22, 23 are arranged to be tensioned to bias leg units 114, 116 toward one another to stiffen frame 112 in response to spreading of leg units 114, 116 away from one another to the unfolded position by leg spreader 118.

Figure 12:
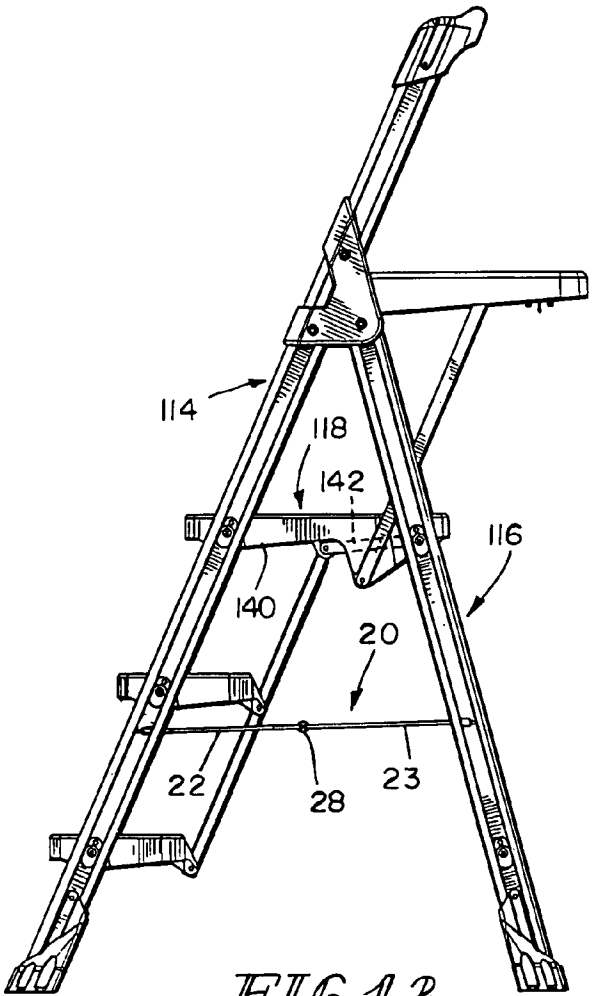
FIG. 12 is a side elevation view showing the ladder of FIGS. 9–11 in an unfolded position.
Figure 11:
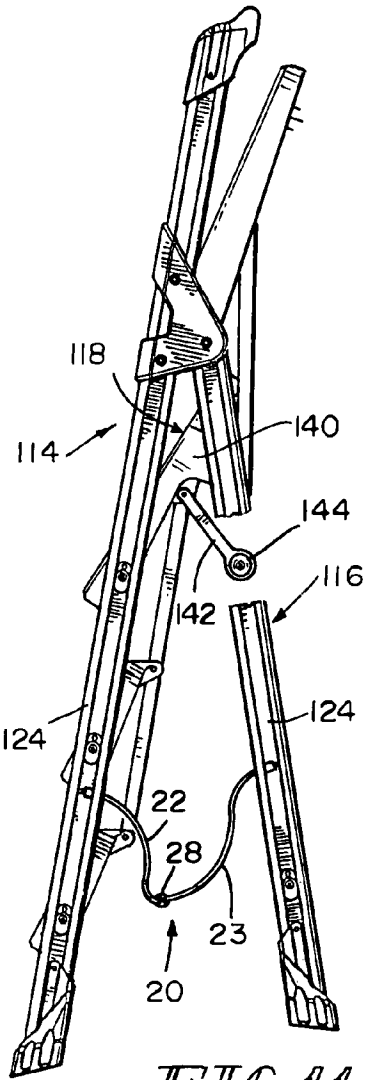
FIG. 11 is a side elevation view showing folding of the ladder of FIGS. 9 and 10.
Figure 10:
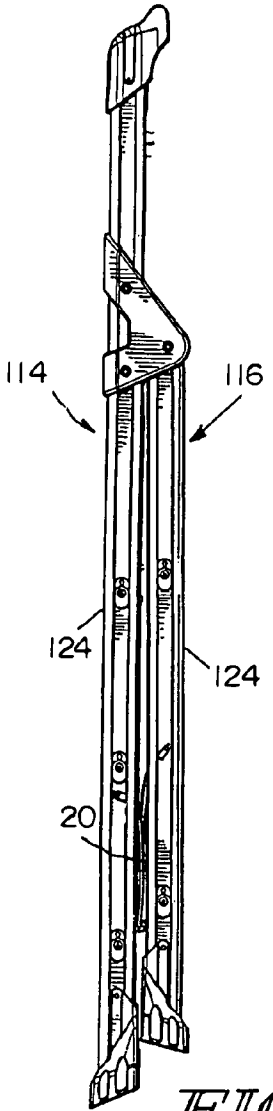
FIG. 10 is a side elevation view showing the ladder of FIG. 9 in a folded position.

Leg spreader 118 is arranged to pivot leg units 114, 116 away from one another to the unfolded position, as suggested in FIGS. 10–12. Leg spreader 18 thus provides means for spreading leg units 14, 16 away from one another to the unfolded position.

Figure 9:
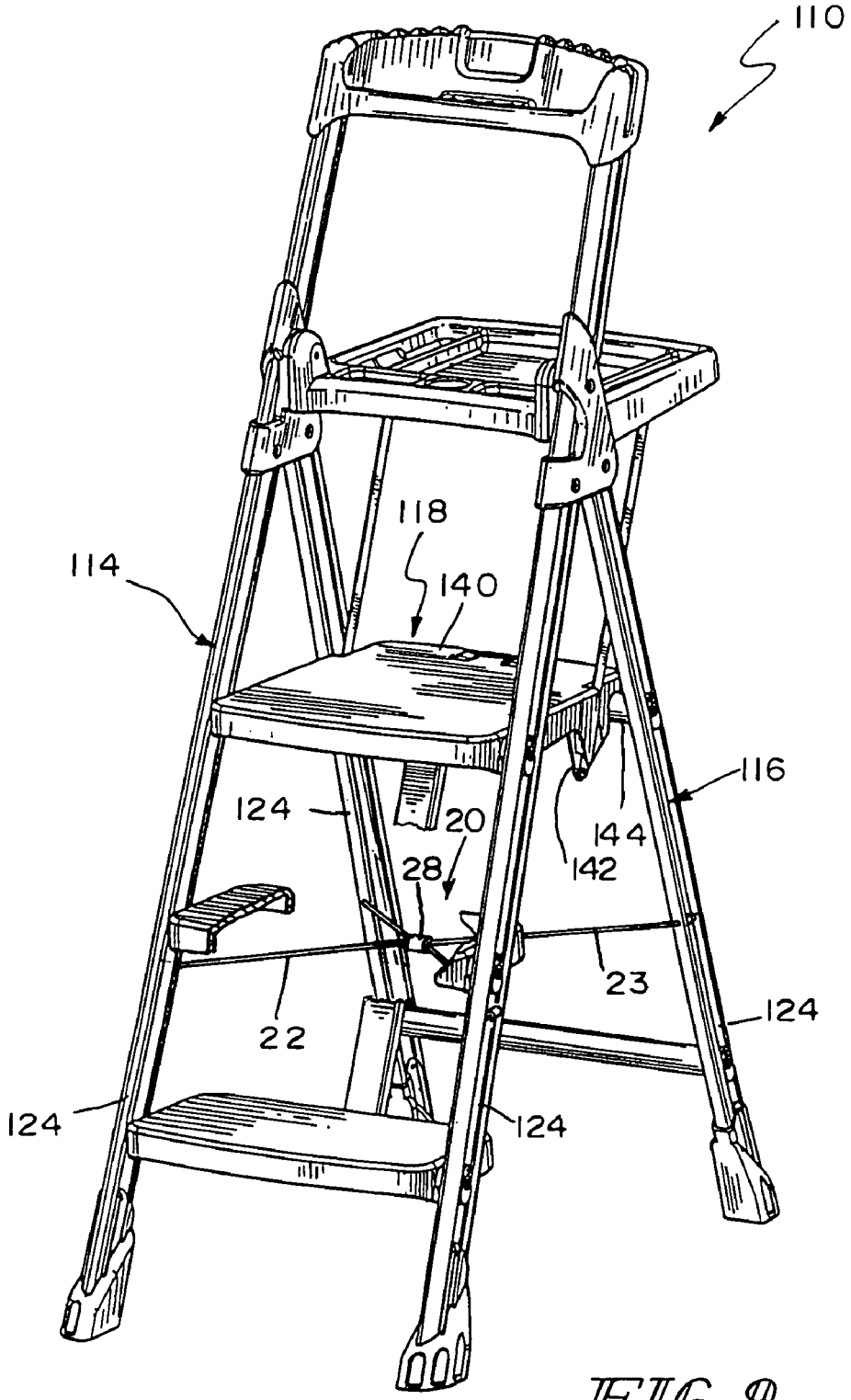
FIG. 9 is a perspective view showing a ladder including the X-shaped leg brace used with another type of leg spreader.

Leg spreader 118 includes a step 140 and at least one link 142, as shown in FIGS. 11 and 12. Step 140 is pivoted to front leg unit 114. Link 142 is pivoted to step 140 and to a cross member 144 mounted to legs 124 of rear leg unit 116. Step 140 and link 142 cooperate to cause relative pivotable movement of leg units 114, 116 between the folded and unfolded positions upon pivotable movement of step 140. When step 140 is pivoted to a horizontal, use position onto cross member 114, as shown in FIGS. 9 and 12, leg units 114, 116 are spread away from one another to the unfolded position. In this way, cables 22, 23 are tensioned to bias leg units 114, 116 toward one another to stiffen frame 112 to promote stability of ladder 110. A latch 146 is mounted to step 140 for engagement with cross member 144 to lock step 140 in its horizontal, use position and thereby lock frame 112 in its unfolded position.

Leg brace 20 is useful with a wide variety of ladders in addition to ladders 10 and 110. Leg brace 20 is useful with the structure disclosed in U.S. Pat. No. 6,427,805, the disclosure of which is hereby incorporated by reference herein.

With respect to ladder 10, leg brace 20 provides means for biasing leg units 14, 16 toward one another to stiffen frame 12 in response to spreading of leg units 14, 16 away from one another to the unfolded position by spreading means 18. With respect to ladder 110, leg brace provides means for biasing leg units 114, 116 toward one another to stiffen frame 112 in response to spreading of leg units 114, 116 away from one another to the unfolded position by spreading means 118.

An optional X-shaped leg brace (not shown) for use with ladders 10, 110 or other ladders includes a pair of cables that crisscross one another and a cable connector coupled to middle portions of the cables. Each cable is coupled to a leg of one leg unit and to a diagonally opposite leg of the other leg unit.

What is claimed is:

1. A ladder comprising a foldable frame including a first leg unit and a second leg unit, the first and second leg units being arranged to move relative to one another between folded and unfolded positions, a leg spreader coupled to the leg units and arranged to spread the leg units away from one another to the unfolded position, and a leg brace comprising a first cable having each of its ends coupled to a different one of the legs of the first leg unit and a second cable having each of its ends coupled to one of the legs of the second leg unit with an apex of each cable coupled to one another by a cable connector so that they become taut and bias the leg units toward one another to stiffen the frame in response to spreading of the leg units away from one another to the unfolded position by the leg spreader wherein the cable connector comprises a sleeve and both apexes of the cables extend through the sleeve and are fixed therein.

2. The ladder of claim 1, wherein the leg brace is X-shaped.

3. The ladder of claim 1, wherein each end portion extends through an aperture formed in the leg to which the end portion is coupled and the leg brace includes a blocker coupled to each end portion to block withdrawal thereof from the aperture through which the end portion extends when the leg units are pivoted to assume the unfolded position.

4. The ladder of claim 1, wherein each leg unit includes a pair of legs and the leg spreader includes an overcenter linkage coupled to one of the legs of each leg unit to lock the leg units in the unfolded position.

5. The ladder of claim 1, wherein the leg spreader includes a step coupled to the first leg unit for pivotable movement and a link coupled to the step and the second leg unit to cause relative pivotable movement of the leg units upon pivotable movement of the step.

6. The ladder of claim 1, wherein the cables are flexible and include metal strands.

7. A ladder comprising a foldable frame including a first leg unit and a second leg unit, the first and second leg units being arranged to move relative to one another between folded and unfolded positions, a leg spreader coupled to the leg units and arranged to spread the leg units away from one another to the unfolded position, and a leg brace coupled to the leg units and arranged to bias the leg units toward one another to stiffen the frame in response to spreading of the leg units away from one another to the unfolded position by the leg spreader, wherein each leg unit includes a pair of legs, the leg brace includes a first cable including an end portion coupled to each leg of the first leg unit, a second cable including an end portion coupled to each leg of the second leg unit, and a cable connector coupled to a middle portion of each cable, wherein the cable connector includes a sleeve, the middle portion of each cable extends through the sleeve, and the sleeve is deformed to grip the middle portion of each cable.

8. A ladder comprising a foldable frame including a first leg unit and a second leg unit, the first and second leg units being arranged for pivotable movement relative to one another between folded and unfolded positions, each leg unit including a pair of legs, a leg spreader coupled to the leg units and arranged to pivot the leg units away from one another to the unfolded position, and an X-shaped leg brace including a cable coupled to each leg of the leg units and arranged to be tensioned to bias each leg toward a central portion of the leg brace to stiffen the frame in response to pivotable movement of the leg units away from one another to the unfolded position by the leg spreader, wherein the leg brace includes a first cable coupled to the legs of the first leg unit, a second cable coupled to the legs of the second leg unit, and a sleeve that surrounds and is crimped to a middle portion of each cable.

9. A ladder comprising a frame including a first leg unit and a second leg unit, each leg unit including a pair of legs, and an X-shaped leg brace including a cable coupled to each leg of the leg units, wherein the leg brace includes a first cable including an end portion coupled to each leg of the first leg unit, a second cable including an end portion coupled to each leg of the second leg unit, and a cable connector coupled to a middle portion of each of the first and second cables, wherein the cable connector includes a sleeve, the middle portion of each of the first and second cables extends through the sleeve, and the sleeve is deformed to grip the middle portion of each of the first and second cables.

* * * * *